US006871692B2

(12) United States Patent
Hamilton et al.

(10) Patent No.: US 6,871,692 B2
(45) Date of Patent: Mar. 29, 2005

(54) METHOD AND APPARATUS FOR CASTING METAL

(75) Inventors: Ernest Hamilton, Ontario (CA); David Beale, Ontario (CA)

(73) Assignee: Outokumpu Oyj Espoo (FI)

( * ) Notice: Subject to any disclaimer, the term of this patent is extended or adjusted under 35 U.S.C. 154(b) by 0 days.

(21) Appl. No.: 10/854,127

(22) Filed: May 25, 2004

(65) Prior Publication Data

US 2004/0216859 A1 Nov. 4, 2004

Related U.S. Application Data

(62) Division of application No. 10/380,139, filed as application No. PCT/FI01/00838 on Sep. 27, 2001, now Pat. No. 6,805,190.

(30) Foreign Application Priority Data

Sep. 29, 2000 (FI) ..... 20002142

(51) Int. Cl.[7] ..... B22D 5/02

(52) U.S. Cl. ..... 164/323; 164/325; 164/337; 164/266

(58) Field of Search ..... 164/323, 325, 164/337, 266, 130, 136

(56) References Cited

U.S. PATENT DOCUMENTS 6,805,190 B2 * 10/2004 Hamilton et al. ..... 164/130

FOREIGN PATENT DOCUMENTS

WO 02/22292 * 3/2002

* cited by examiner

*Primary Examiner*—Tom Dunn
*Assistant Examiner*—I.-H. Lin
(74) *Attorney, Agent, or Firm*—Smith-Hill and Bedell

(57) ABSTRACT

An apparatus and a method for the casting of metals comprising the steps of:

indexing a mould (3) in series on a rotating carousel (2) to a pouring station (2.1), skimming station (2.2) and a mould transfer station (2.3);

casting molten metal into the mould at the pouring station (2.1);

skimming dross from the molten metal at the skimming station (2.2);

transferring the mould (3) containing molten metal from the mould transfer station (2.3) to a cooling section (5) and replacing it at the mould transfer station (2.3) with an empty mould;

transferring a cooled mould containing a solidified metal ingot (10) from the cooling section (5) to a demoulding station (7) remote from the rotating carousel (2);

removing the solidified ingot (10) from the mould (3);

removing the pin/hook members (11) from the ingot (10);

returning the pin/hook members (11) to the empty mould (3);

returning the empty mould (3) to the mould transfer station (2.3);

and transferring the ingot (10) to the further processing.

9 Claims, 4 Drawing Sheets

METHOD AND APPARATUS FOR CASTING METAL

CROSS REFERENCE TO RELATED APPLICATION

This application is a DIV of Ser. No. 10/380,139, filed on Jun. 6, 2003 now issued as U.S. Pat. No. 6,805,190, which is 371 of PCT/FI01/00838, filed on Sep. 27, 2001.

BACKGROUND OF THE INVENTION

1. Field of the Invention

The invention relates to method and apparatus for the casting of metals. It specifically relates to methods and apparatus systems for automatic casting of metals, particularly non-ferrous metals such as zinc, aluminium, tin, lead and alloys. More specifically the invention relates to methods and apparatus for casting metal ingots, especially jumbo ingots.

2. Description of Related Art

In metal refining it is often necessary to transport raw material from place to place so it may be delivered to a facility where it can be reworked into an eventual end product. One easily transported form is a foundry ingot. Therefore, it is common to form metal into foundry ingots for the purpose of shipping and transportation to end users. Such end users they may use the foundry ingots as feed stock for a further operation.

It is known from the prior art e.g. CA 2,240,332 a system for the automatic casting of metals, especially zinc, which includes a four station indexing carousel for indexing moulds. The stations are casting station, where metal is cast via a launder, a skimming station where an automatic robot controlled skimmer removes dross, a transfer station from which moulds containing molten metal are removed by an overhead crane to be placed in a cooling tank and cooled moulds containing the solidified ingot are returned by the crane to the transfer station of the carousel, and a delivery station where the cast ingots are removed from the moulds by another overhead crane. The empty moulds are recycled to the casting station. This system layout and its product flow are rather complicated. The cooled mould with the solidified ingot is returned from the cooling tank to the casting carousel. Thus the mould is placed in the transfer station two times in a working cycle before the solidified ingot is removed. The ingot is removed at the delivery station of the indexing carousel. The delivery station and the casting station are very near each other. This can be hazardous to the operation personnel. Furthermore the product flow of cast jumbo ingots is complex. Moreover, the fast movements of the overhead crane, when moving the mould with molten metal, can lead to the decreased quality of the ingot surface.

SUMMARY OF THE INVENTION

The object of the present invention is to realize a method and apparatus for casting metal ingots, by means of which the drawbacks of the prior art are avoided. Another object of the invention is to achieve a casting method and apparatus that is more effective than those of the prior art. Likewise, an object of the invention is to realize a method and apparatus that is better suited for the casting of jumbo ingots than the prior art arrangements.

The invention is characterized by what is set forth in the appended claims. The method according to the invention is characterized, among others, in that the method for the casting of metals comprising the steps of: indexing a mould in series on a rotating carousel to a pouring station, skimming station and a mould transfer station; casting molten metal into the mould at the pouring station; skimming dross from the molten metal at the skimming station; transferring the mould containing molten metal from the mould transfer station to a cooling section and replacing it at the mould transfer station with an empty mould; transferring a cooled mould containing a solidified metal ingot from the cooling section to a demoulding station remote from the rotating carousel; removing the solidified ingot from the mould; removing the pin/hook members from the ingot; returning the pin/hook members to the empty mould; returning the empty mould to the mould transfer station; and transferring the ingot to the further processing.

An embodiment of the method according to the invention is characterized in that the mould is transferred by a transfer car and/or by lifting device from mould transfer station to the cooling section. An embodiment of the method according to the invention is characterized in that the empty mould is returned to the mould transfer station by a transfer car. The mould with molten metal is transferred from the transfer car to a cooling chamber of the cooling section by a lifting device. The ingot is further transferred from the demoulding station to a pin/hook member removal station. The pin members are removed by pushing the pin members from the ingot. The cooling section is located between the carousel and the demoulding station. The transfer car is moved on a track between the carousel and the demoulding station. The cooled mould containing the ingot is transferred from cooling chamber to the demoulding station by the lifting device, especially by a crane device.

The apparatus for casting metal ingots according to the invention, comprises: a feed system for delivering molten metal to be cast; an indexing carousel at the end of feed system for indexing moulds provided thereon, comprising:

- a pouring station for pouring molten metal into a mould;
- a skimming station for skimming dross from the surface of molten metal;
- a mould transfer station for transferring the mould with molten metal from indexing carousel and replacing it with an empty mould; and drive means for rotating the carousel;

transfer means for transferring the mould with molten metal from the mould transfer station of the carousel to a cooling section and returning the empty mould back to the mould transfer station of the carousel; a cooling section, comprising a plurality of cooling chambers; a demoulding station, for removing a solidified ingot from the mould; and means for transferring ingot to further processing.

A preferred embodiment of the apparatus according to the invention is characterized in that the transfer means comprise a transfer car and a crane device. The apparatus further comprises a pin and/or hook member removal station located at or after the demoulding station. The pouring station comprises means for moving the mould in vertical direction. The skimming station is provided with means for automatic skimming of dross from molten metal contained in the mould. The indexing carousel is provided with cradles to hold moulds. The feed system comprises a pouring tundish for delivering molten metal to a mould at the pouring station and a stopper rod means for opening and closing a pouring orifice of the tundish. The stopper rod means comprise control means and measuring means of the level of metal in the mould and/or measuring means of the tundish level. A shuttle car is provided to transfer the empty mould between demouding station and the pin/hook removal station.

The casting method and the apparatus according to the invention have several remarkable advantages. The demolding and ingot discharge zone is well away from the actual molten metal pouring station, which promotes a better flow of ingots out of system and is less hazardous for the operation personnel. The layout of the system according to the invention is shorter than the prior art system for given production rate. Moreover the system according to the invention permits slower overhead crane movements for the mould with molten metal, which promotes smoother ingot surface finish. Furthermore, the three position carousel reduces space required around the pouring zone and furnace and reduces any man power requirements in this area. In addition the three station carousel allows the continuation of the pouring operation if demolding operation stops for any reason.

BRIEF DESCRIPTION OF THE DRAWING

The invention is described in more detail below by means of examples and with reference to the appended drawings, where.

DETAILED DESCRIPTION OF THE PREFERRED EMBODIMENTS

Figure 1:
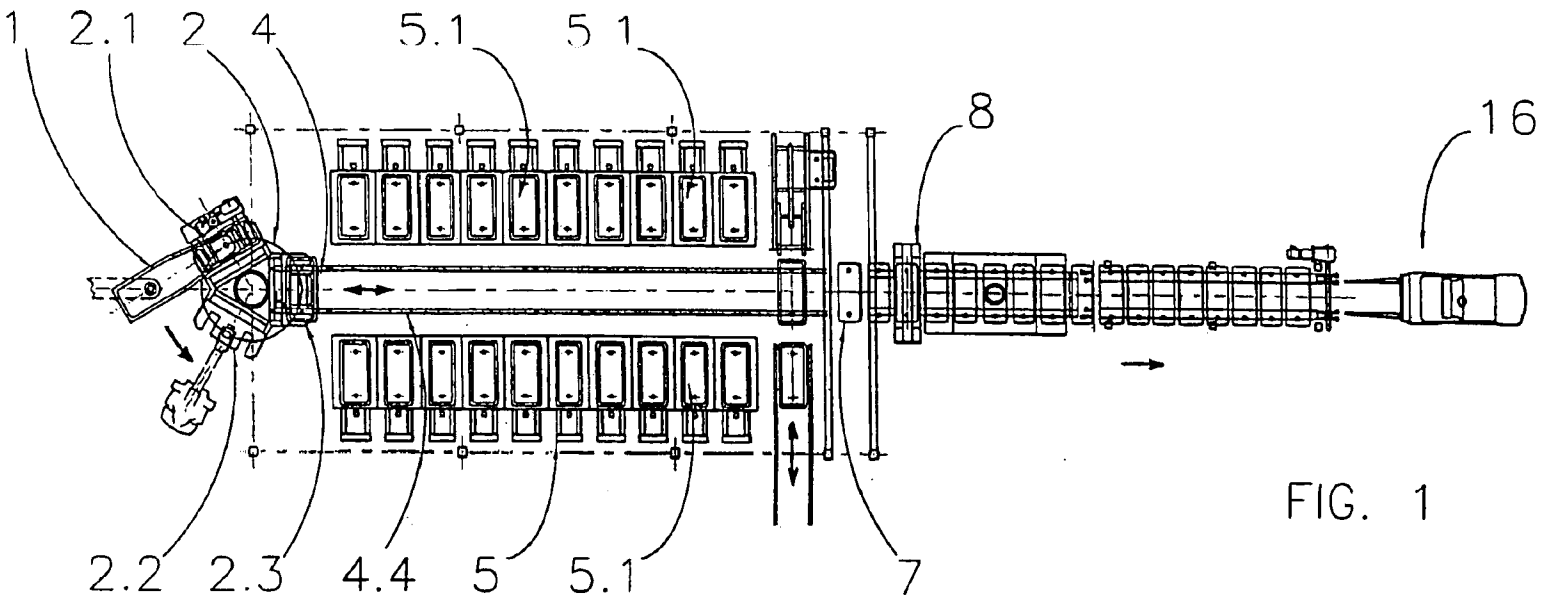
FIG. 1 shows a general plan view of the casting system according to the invention.

Turning to FIG. 1, an ingot casting system is shown generally. The system is designed to receive molten metal M, e.g., zinc, from the molten metal pumping and launder system into a pouring tundish 1 that feeds a three position casting carousel 2. After a mould 3 has been filled at pouring station 2.1 of the carousel, the carousel indexes to present a new mould to the pouring station 2.1 under the pouring tundish 1. Equipment is provided at the pouring station 2.1 to reduce the amount of dross and skimmings formed and automatically control the level of metal in the mould. At the second position of the carousel, the skimming station 2.2, dross and skimmings are skimmed from the molten metal surface in the mould 3. At the third position of the carousel 2, a mould transfer station 2.3, the mould containing molten metal is removed by transfer means such as a transfer car 4 to a cooling section 5 remote from the mould transfer station 2.3 and replaced with an empty mould.

At the cooling section 5, a lifting apparatus, typically a crane device 6 lifts the mould 3 containing molten metal from the transfer car 4 into a cooling chamber 5.1. After the predetermined cooling cycle is completed, the crane 6 transports the cooled mould containing the solidified ingot 10 to the demoulding station 7. At the demoulding station 7 the solidified ingot 10 is removed from the mould 3. After the demoulding station the ingot 10 is transferred to a pin/hook removal station 8. At the pin removal station 8 the core pins 11 are removed from the ingot 10 and the core pins 11 are replaced in the mould 3. The empty mould 3, with the core pins 11 replaced in the proper positions, is picked up by the transfer car 4 and returned to the mould transfer station 2.3 on the carousel 2. The ingot 10 is transferred from the pin removal station 8 on a transfer conveyor to further processing phases such as secondary ingot cooling 9, weighing, marking, stacking 12 and shipping 13.

The mould 3 used with this system will generally be formed of a conventional metal material such as steel or cast iron. The sides 3.1 of the mould 3 are preferable slightly angled to the vertical to create a wedge shaped cast ingot that can be readily removed therefrom. The floor of the mould includes a plurality of recesses 3.3 and raised 3.4 portions which serve to allow access to fork truck tines. Where the mould is designated for casting of a metal such as zinc, it may typically have a capacity to handle a large zinc ingot, such as a jumbo ingot.

Figure 8:
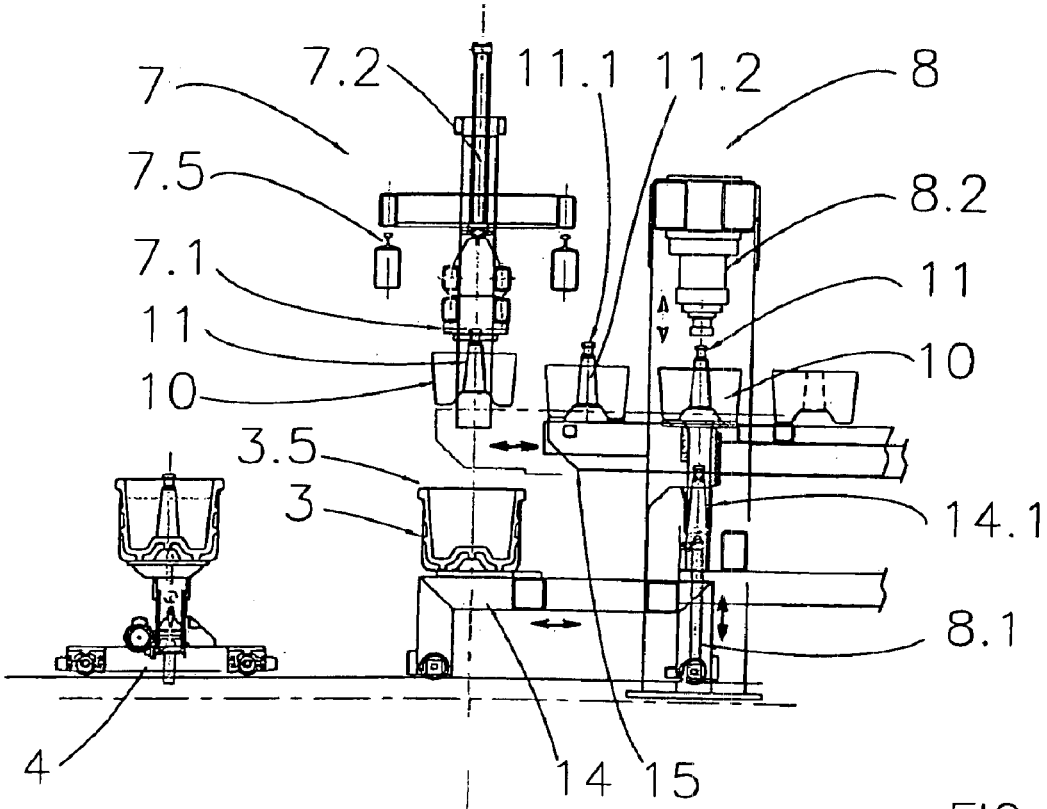
FIG. 8 shows a side elevation of the demoulding and the pin removal stations.

The raised portions 3.4 in the mould also provide a base to rest two pins 11 which will ultimately be used to assist in handling the cast ingot 10 when the metal has solidified. The pins 11 typically comprise an enlarged head 11.1 and a tapered body 11.2 (shown in FIG. 8). The tapered pins have the wider part of the taper located below the narrower part. An annular recess formed between the head and tapered body provides an anchor point for hooks used to lift the cast ingot out of the mould.

The casting system works typically as follows: Molten metal M such as zinc is delivered by pump and launder system into the pouring tundish 1 of the casting machine. The tundish 1 is equipped with a laser level measurement system that controls the level of metal in the tundish. The discharge to the mould is controlled by an orifice 1.1—stopper rod system. The stopper rod (known as such) is controlled by either the level of metal in the mould or the tundish level as explained below. The pouring tundish level control system operates as follows: While a mould is being filled, the stopper rod is set at a fixed position to deliver the desired amount of metal to the mould. The tundish metal level is controlled at its normal operating set point by varying the speed of the molten metal delivery pump. This control is achieved by using the level measured by laser level system. As the mould is being filled the level of molten metal in the mould is, advantageously constantly, monitored with laser. When the molten metal in the mould reaches the desired metal level, the stopper rod closes to stop the flow of metal to the mould while mould is lowered to the carousel and next mould indexes into position. While the stopper rod is closed the tundish accumulates the continuous flow of metal from the launder system at the operating rate. During this period the laser level does not control the molten metal pump speed. When the new mould enters the pouring station it is raised by the mould lift system to the upper position. When the mould is in position the stopper rod opens to discharge the metal accumulated during the indexing cycle into the mould. This stopper rod position discharges the metal at a much higher rate than the normal operating rate. This causes the metal level in the tundish to quickly return to the normal operating level. When this level is reached, the laser level system resumes control of the feed pump and the stopper rod return to the fixed position to reduce the flow of molten metal to the mould to the normal operating rate.

The mould 3 is filled by under pouring below the surface of the metal in the mould. This ensures that no dross is formed by aeration as the molten metal enters the mould.

Figure 4:
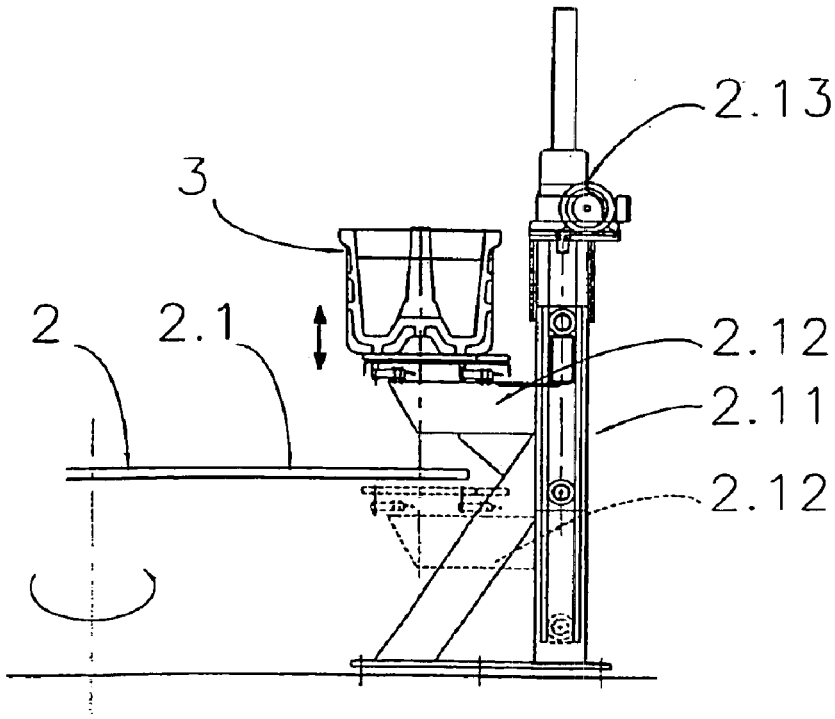
FIG. 4 shows a side elevation of the lifting device of the pouring station.
Figure 5:
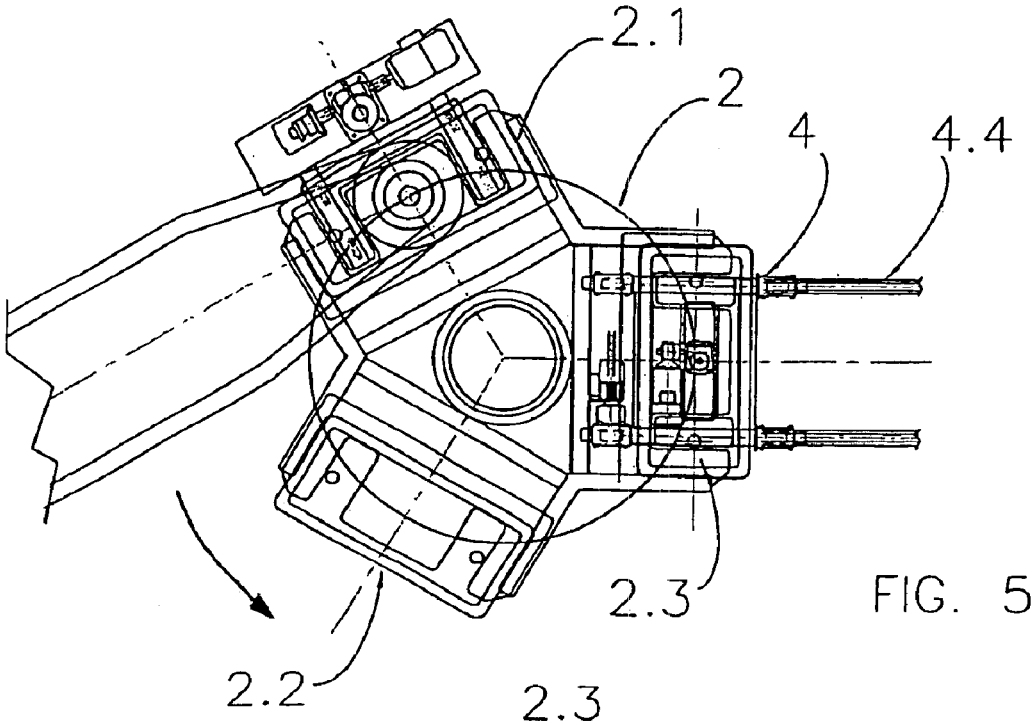
FIG. 5 shows a plan view of the carousel of the casting system.
Figure 6:
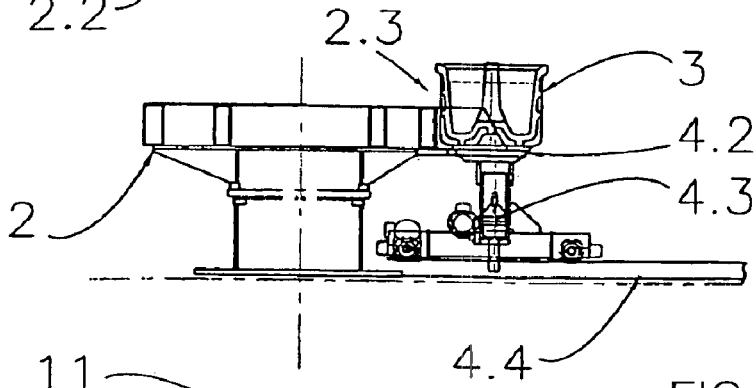
FIG. 6 shows a side elevation of the mould transfer station of to carousel and the transfer car.
Figure 7:
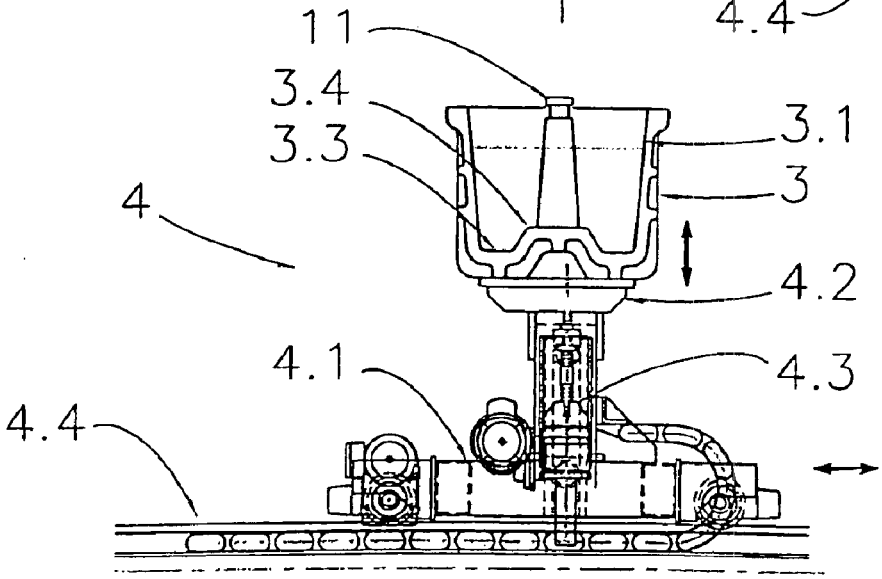
FIG. 7 shows a side elevation of the transfer car.

This mould lifting system operates as follows: As each new mould is indexed into the pouring station 2.1 by the carousel 2 it is lifted by a mould lifting system 2.11 (FIG. 4). The mould is lifted until the pouring spout 1.1 is near the bottom of the mould 3. The flow of molten metal is then initiated as the stopper rod opens. The flow of molten metal into the mould quickly submerges the end of the pouring spout and the balance of the mould filling takes place with the spout submerged to prevent dross formation. As the mould is being filled the level of molten metal is continuously measured. This information is used to lower the mould lift table 2.12 at a rate such that the tip of the pouring spout remains a constant distance below the surface of the molten metal as it fills the mould. When the desired (ingot) height level has been reached, the stopper rod closes to shut off the flow of molten metal into the mould and the mould lift table 2.12 descends to replace the mould onto the carousel. The carousel 2 indexes and the mould lift, pour and lowering cycle repeats with each subsequent mould. The mould lift table is moved with an actuator device 2.13, such as a jack.

The second position 2.2 on the casting carousel allows access for skimming the molten metal in the mould. The skimming operation can be manual or automated. A robot skimming system can be installed at this position. The robot skimming system typically comprises of: a multi-axis industrial robot, a custom designed end of arm tool to skim the mould surface, a skimming discharge and end of arm tool cleaning system and two replaceable skims receiving hoppers. The automatic skimming system will be programmed to automatically skim the entire surface of molten metal in the mould, translate to the skims discharge clean off station and return to the home position to skim the next mould when it is presented.

As the skimmed mould 3 filled with molten metal indexes to the third position 2.3 on the carousel 2 it is removed to the cooling section by the transport car 4. The transport car 4 serves the dual function of removing a full mould 3 from the carousel 2 and placing an empty mould (core pins in place) onto the carousel. The transfer car 4 comprises a self-propelled, low profile wagon 4.1 equipped with a lift/lower table 4.2. The lift/lower table is moved by a actuator device 4.3, such as a jack. The transfer car 4 travels on track, typically on rails 4.4, between two banks of cooling boxes 5.1, from the casting carousel 2 to the demoulding station 7 and back. The transfer car 4 passes under the third position (the mould removal station 2.3) of the carousel and the lift table 4.2 raises to lift the mould 3, containing molten metal, clear of the carousel 2. The transfer car 4 then moves away from the carousel and carries the mould into the next sequenced cooling position where it stops. The lifting device, typically an overhead crane 6 removes the mould from the transfer car 4 and places it into an empty cooling chamber 5.1. The empty transfer car then proceeds to the demoulding station 7 where it picks up an empty mould, which has had the ingot 10 removed and pins 11 replaced, and returns it to the carousel 2. The transfer car 4 picks up the empty mould by entering under the mould shuttle car 14 at the demoulding station 7 and lifting it in a similar manner as at the carousel.

The operations performed by the overhead crane 6 are integrated with those of the transport car 4 and pin removal system. There are sensor devises and control systems, such as automatic sensors and a logic program, employed to control the sequence of the total system. Normally, when the transfer car 4 carrying a mould 3 full of molten metal arrives at the next sequence position, the crane 6 will be waiting over the transport car rails ready to receive the mould. The mould with molten metal is lifted from the transfer car by the crane and placed into an empty cooling chamber. Immediately after the transfer car has been relieved of its load it proceeds to retrieve an empty mould and returns it to the mould removal station on the carousel.

After the crane has deposited the mould, it indexes to the next sequence position and removes a solidified mould that has completed its cooling cycle. The crane carries the solidified mould to the pin removal system and deposits it onto the empty mould shuttle car. The crane then proceeds to the next empty cooling chamber of the cooling section 5 in the sequence where it awaits delivery of a mould of molten metal by the transfer car.

The cooling system consists of a series of individual cooling chambers 5.1 into which moulds of molten metal are placed by the overhead crane 6. The cooling water delivery system is designed to direct the water flow on the mould surface to promote high heat transfer rates and cooling the ingot. Adjustable weirs are provided to control cooling water overflow levels at the desired height for different sizes of ingots.

Each newly poured mould is placed into the most recently vacated cooling chamber 5.1. When the mould is in position a lid 5.2 of the chamber is closed and the cooling water flow is initiated. There are advantageously heating elements provided in the cooling chamber lid 5.2 serve to control the rate of surface cooling and reduce imperfections in the surface of the solidifying ingot. When the predetermined cooling cycle has been completed the lid is opened to allow the crane access to remove the mould with the solidified ingot and transport it to the demoulding station. The cooling chamber lids are automatically opened and closed by an actuator device 5.3, such as a pneumatic cylinder-piston combination. Each cooling chamber is advantageously equipped with multiple water inlets, overflows and drains to accommodate different size ingots and operating procedures.

The demoulding station 7 and the pin removal station 8 automatically performs three functions: The solidified ingot 10 is removed from the mould 3, the pins 11 are removed from the ingot 10 and the pins 11 are returned to the empty mould, which is picked up by the transfer car 4 for return to the casting carousel 2.

The mould with solidified ingot is placed onto the mould shuttle car 14 and indexed into the demoulding station 7. The ingot 10 is removed from the mould by means of grab devices 7.1 typically mounted on vertical cylinder-piston combinations 7.2. The grab devices 7.1 engage the cast-in pins 11 and lift the ingot 10 from the mould 3. Simultaneously with this lifting motion, a downward pressure is applied on the mould lip 3.5 to ensure that the ingot 10 does not stick in the mould causing it to lift with the ingot.

The ingot 10 is lifted to a position above the elevation of the walking beam 15 by the cylinder-piston combinations 7.2 of the demoulding station 7. While the ingot 10 is suspended in this position, the walking beam 15 passes under the ingot 10 and moves to support the ingot. The grab means 7.1 release the pins 11 and the ingot 10 is indexed into the pin removal station 8 by the walking beam 15.

At the pin removal station a pair of pin receiving cylinders 8.1 are extended to support the pins 11 from the bottom as the pin press device 8.2 applies a downward pressure on the top of the pins 11 to push them from the ingot 10. The pin receiving cylinders 8.1 prevent the pins 11 from being ejected with great force and lowers them into a pair of pin holding containers 14.1 that are mounted on the mould shuttle car 14 movable between the demoulding station 7 and the pin removal station 8. After the pins 11 have been captured by the pin holding containers 14.1, the mould shuttle car 14 moves to place the pin holding containers beneath the demoulding station 7. The demoulding cylinders 7.2 descend and the grab means 7.1 engage the two pins 11.

The pins are lifted from the pin holding containers 14.1 and the mould shuttle car 14 moves the mould 3 back to the demoulding station 7. The pins 11 are lowered into their proper position in the mould 3 and released by the grab means 7.1. The demoulding cylinders 7.2 withdraw and the mould shuttle car 14 moves the mould to the inlet station. The transfer car 4 picks up the mould 3 and returns it to the mould transfer station 2.3 of the carousel 2. The empty mould shuttle car 14 waits in this position for a new mould containing a cooled ingot 10 to be placed by the crane 6.

The completed ingots 10 are indexed from the pin removal station 8 by the transfer means such as the walking beam 15 to a fork lift 16 pick up station 13.

Figure 9:
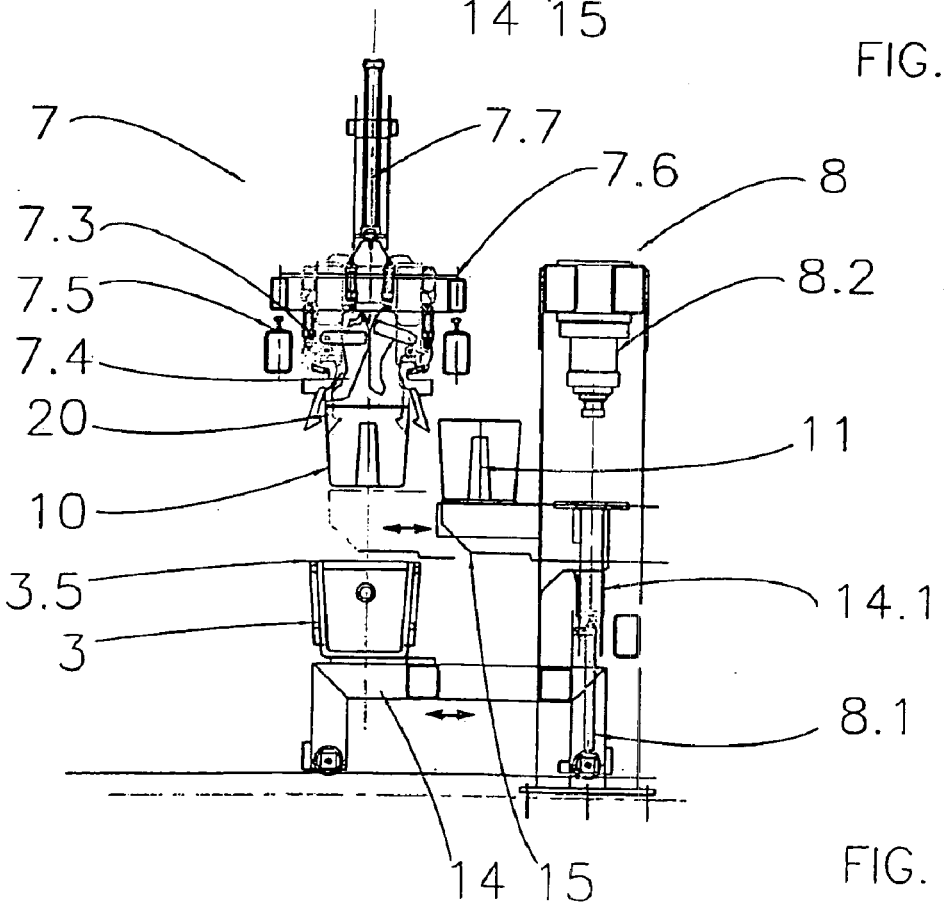
FIG. 9 shows a side elevation of the demoulding and the hook removal station.

It is possible to provide a system for ingots having hooks 20 instead of pins (FIG. 9). This system is mounted on a common carrier frame 7.6 with the pin removal and demoulding system. The carrier frame 7.6 is supported by set of wheels that run on rails 7.5 perpendicular to the casting line. The carrier frames and rails are designed such that either systems for demoulding and hook 20 removal or system for demoulding and pin 11 removal is in position over the demoulding station 7. The selected system is moved into position by an actuation device such as a hydraulic cylinder. The system for demoulding and hook removal operates as follows: The ingot 10 is removed from the mould 3, the hooks 20 are removed from ingot 10 and the hooks are replaced into their proper position in the empty mould 3.

A mould 3 with solidified ingot is indexed into the demoulding station 7 by the shuttle car 14. The ingot 10 is removed from the mould 3 by a pair of grab devices 7.3 mounted advantageously on a vertical cylinder-piston combination 7.7. The grab devices 7.3 engage the hooks 20 and lift the solidified ingot 10 from the mould 3. Simultaneously with this lifting motion, a downward pressure is applied on the mould lip 3.5 to ensure that the ingot 10 does not stick in the mould.

The ingot is lifted to a position above the elevation of the walking beam 15 by the demoulding cylinders. While the ingot is suspended in this position, the walking beam 15 extends under the ingot 10 and lifts to support the ingot. When the ingot is supported, a pair of hook removal devices 7.4 are actuated to push the hooks 20 sideways to disengage them from the ingot 10. The demoulding cylinders and grab devices are designed to move laterally a sufficient distance for the hooks to clear their indentations in the ingot. When the hooks 20 are clear of the ingot 10, the walking beam 15 indexes to move the ingot 10 towards the discharge end of the system. During this operation, the hook grab devices maintain their grip on the hooks.

When the ingot 10 has indexed from the demoulding station, the demoulding cylinders move laterally back into their normal position and lower the hooks 20 into the empty mould 3. When hooks are properly positioned, the grab devices release the hooks and the cylinders lift to await the next ingot.

The mould shuttle car 14 then indexes the empty mould, with hooks in place, to the transfer car station where it is picked up by the transfer car 4 and returned to the mould transfer station 2.3 on the carousel 2.

Figure 2:
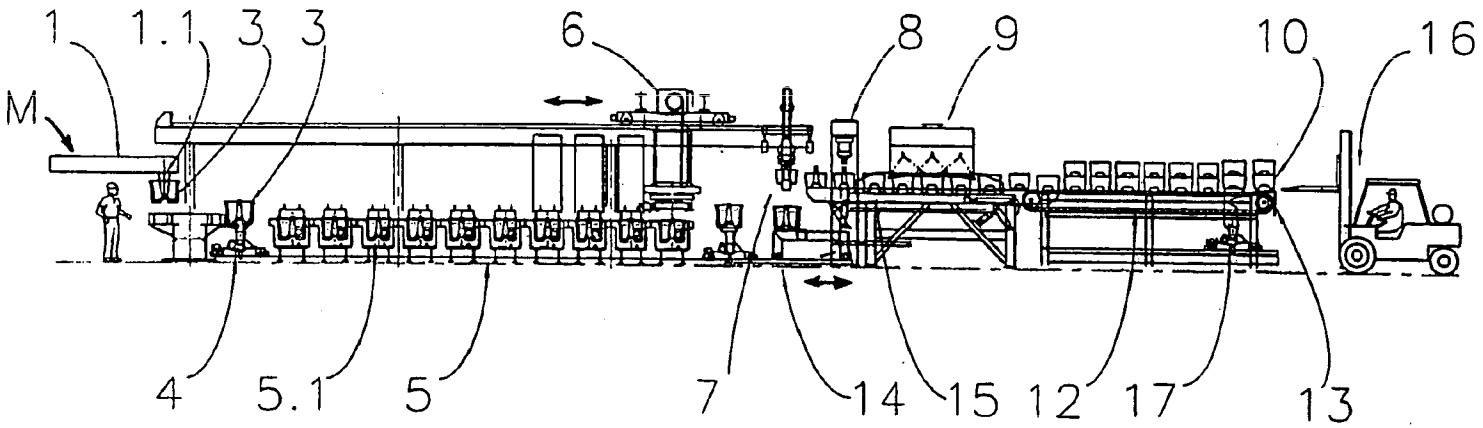
FIG. 2 shows a side view of the casting system of FIG. 1.
Figure 3:
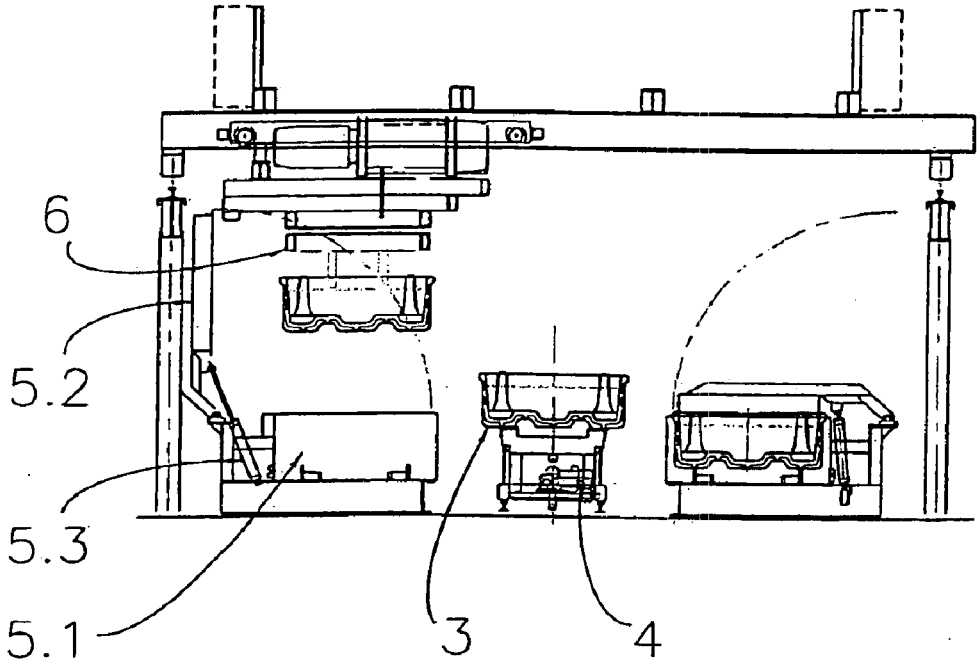
FIG. 3 shows a front elevation of the cooling section and the crane device.

In the FIGS. 1 and 2 is shown a secondary cooling system 9 that utilizes advantageously cooling spray devices to cool each ingot 10. As each ingot is received from the pin (or hook) removal station, it enters to the secondary cooling system. System can be also provided with an automatic weighing system installed advantageously on the last station of the walking beam 15. The weighing operation is done while the ingot 10 is stationary on the conveyor. This system can be also provided with an ingot marking station. Typically there is an automatic ink jet printing device provided to perform this function.

In FIG. 2, an ingot accumulation conveyor 12 is shown. The ingot accumulation system receives each ingot 10 as it is produced from earlier phases of the production system. The ingot accumulation system is comprised of a conveyor 12, typically two strand chain conveyor, with sufficient length and a second transfer car 17 that runs between the chains of the conveyor. The system operates as a buffer storage and retrieval system. The conveyor 12 stores the ingots and the second transfer car 17 retrieves the stored ingots from the conveyor and delivers them to the fork lift pick-up stand 13 located at the discharge end of the conveyor 12. The conveyor is typically moved using a step-by-step action. This moves all the ingots on the conveyor one step towards the discharge end of the conveyor and creates an empty space at the conveyor inlet end. The system typically comprises means for detecting the presence and/or position of an ingot on the conveyor. The second transfer car 17 is moved from the cooling chamber discharge to the fork lift pick-up stand. In normal operation, the second transfer car picks up the ingot closest to the discharge end of the conveyor and places it on the fork lift pick-up stand. The second transfer car then returns to the next available ingot on the conveyor, picks it up and advances to the position immediately in front of the pick-up stand.

What is claimed is:

1. An apparatus for casting metal ingots, comprising: a feed system for delivering molten metal to be cast; an indexing carousel at the end of feed system for indexing moulds provided thereon, comprising: a pouring station for pouring molten metal into a mould; a skimming station for skimming dross from the surface of molten metal; a mould transfer station for transferring the mould with molten metal from the indexing carousel and replacing it with an empty mould; and drive means for rotating the carousel; transfer means for transferring the mould with molten metal from the mould transfer station of the carousel to a cooling section and returning the empty mould back to the mould transfer station of the carousel; a cooling section, comprising a plurality of cooling chambers; a remote demoulding station, for removing a solidified ingot from the mould; and means for transferring ingot to further processing.

2. Apparatus according to claim 1 wherein the pouring station comprises means for moving the mould in vertical direction.

3. Apparatus according to claim 1 wherein the skimming station is provided with means for automatic skimming of dross from molten metal contained in the mould.

4. Apparatus according to claim 1 wherein the indexing carousel is provided with cradles to hold moulds.

5. Apparatus according to claim 1 wherein the feed system comprises a pouring tundish for delivering molten metal to a mould at the pouring station and a stopper rod means for opening and closing a pouring orifice of the tundish.

6. Apparatus according to claim 5 wherein the stopper rod means comprise control means and measuring means of the level of metal in the mould and/or measuring means of the tundish level.

7. Apparatus according to claim 1 wherein a shuttle car is provided to transfer the empty mould between demouding station and the pin/hook removal station.

8. Apparatus according to claim 1 wherein the transfer means comprise a transfer car and a crane device.

9. Apparatus according to claim 1 wherein the apparatus further comprises a pin and/or hook member removal station located at or after the demoulding station.

* * * * *